United States Patent [19]

Ingle et al.

[11] Patent Number: 4,730,144

[45] Date of Patent: Mar. 8, 1988

[54] COLOR PICTURE TUBE HAVING INLINE ELECTRON GUN WITH COMA CORRECTION MEMBERS

[75] Inventors: Arthur J. Ingle, East Hempfield Township, Lancaster County, Pa.; Roger C. Alig, Princeton Junction, N.J.

[73] Assignee: RCA Corporation, Princeton, N.J.

[21] Appl. No.: 900,971

[22] Filed: Aug. 27, 1986

[51] Int. Cl.[4] ..... H01J 29/51; H01J 29/76

[52] U.S. Cl. ..... 313/413; 313/412

[58] Field of Search ..... 313/412, 413, 414, 428

[56] References Cited

U.S. PATENT DOCUMENTS

| | | | |
|---|---|---|---|
| 3,548,249 | 12/1970 | Yoshida et al. | 315/13 |
| 3,594,600 | 7/1971 | Murata et al. | 313/79 |
| 3,860,850 | 1/1975 | Takenaka et al. | 313/428 |
| 3,873,879 | 3/1975 | Hughes | 315/13 C |
| 4,142,131 | 2/1979 | Ando et al. | 315/368 |
| 4,196,370 | 4/1980 | Hughes | 313/413 |
| 4,225,804 | 9/1980 | Bekaert et al. | 313/412 |
| 4,396,862 | 8/1983 | Hughes | 313/413 |
| 4,556,819 | 12/1985 | Chen et al. | 313/413 |

FOREIGN PATENT DOCUMENTS 53-42672 4/1978 Japan .

OTHER PUBLICATIONS

"Electron Gun Shunt Designs for Coma Correction", by P. T. Greninger, *Technical Notes,* A Publication of RCA, Princeton, NJ, TN No. 1300, Apr. 1982, 2 pages.

*Primary Examiner*—David K. Moore
*Assistant Examiner*—K. Wieder
*Attorney, Agent, or Firm*—Eugene M. Whitacre; Dennis H. Irlbeck

[57] ABSTRACT

The present invention provides an improvement in a color picture tube having an inline electron gun for generating and directing three inline electron beams, comprising a center beam and two outer beams, along initially coplanar paths toward a screen of the tube. The beams pass through a deflection zone adapted to have two orthogonal magnetic deflection fields established therein. A first of the fields causes deflection of the beams in a first direction perpendicular to the inline direction of the beams, and a second of the fields causes deflection in a second direction parallel to the inline direction of the beams. The gun includes two shunts for shunting portions of both deflection fields around the outer beam paths. Each shunt comprises one magnetically permeable member having an aperture therein. Each shunt completely surrounds one of the electron beam paths. The improvement comprises each shunt being longer in the first direction than in the second direction and being symmetric about a central axis of the shunt that parallels the first direction and symmetric about another central axis of the shunt that parallels the second direction.

2 Claims, 8 Drawing Figures

COLOR PICTURE TUBE HAVING INLINE ELECTRON GUN WITH COMA CORRECTION MEMBERS

BACKGROUND OF THE INVENTION

The present invention relates to a color picture tube having an improved inline electron gun, and particularly to an improvement in the gun for obtaining equal raster sizes (also called coma correction) within the tube, without severely distorting the electron beams.

An inline electron gun is one designed to generate or initiate preferably three electron beams in a common plane and direct those beams along convergent paths to a point or small area of convergence near the tube screen.

A problem that exists in a color picture tube having an inline gun is coma distortion, wherein the sizes of the electron beam rasters scanned on the screen by an external magnetic deflection yoke are different because of the eccentricity of the positions of the two outer beams with respect to the center of the yoke. This coma problem has been solved in the prior art by including various shaped magnetically permeable members adjacent to or around the electron beam paths in a fringe portion of the yoke deflection field. For example, Hughes, U.S. Pat. No. 3,873,879, issued Mar. 25, 1975, teaches the use of small disc-shaped enhancement elements above and below the center beam and ring or washer-shaped shunts around the two outer beams. The enhancement elements concentrate the vertically extending horizontal deflection field lines at the center beam path. The shunts completely surround the outer beams and bypass fringe portions of both vertical and horizontal deflection fields around the outer beams. The shunts also concentrate the horizontally extending vertical deflection field at the center beam path, thereby enhancing the vertical deflection of the center beam. If further enhancement of the vertical deflection of the center beam is required, the outer diameter of the washer-shaped shunts can be enlarged to collect more of the vertical deflection field. However, there is a limit to the maximum size shunt diameter. If the shunts are made too large, they will begin to extend into the area of the center beam. Recently, a yoke has been developed that requires a very large vertical coma correction. It is not possible to use washer-shaped shunts to provide the required coma correction, because the shunts would overlap the center beam. Although coma correction could be provided by the use of other types of shunts, such as C-shaped shunts or D-shaped shunts, the lack of symmetry of such shunts can severely distort the electron beams. Therefore, there is a need for a shunt design that will provide the large coma correction required by the new yoke and will not severely distort the electron beams.

SUMMARY OF THE INVENTION

The present invention provides an improvement in a color picture tube having an inline electron gun for generating and directing three inline electron beams, comprising a center beam and two outer beams, along initially coplanar paths toward a screen of the tube. The beams pass through a deflection zone adapted to have two orthogonal magnetic deflection fields established therein. A first of the fields causes deflection of the beams in a first direction perpendicular to the inline direction of the beams, and a second of the fields causes deflection in a second direction parallel to the inline direction of the beams. The gun includes means for shunting portions of both deflection fields around at least one beam path. The shunting means comprises at least one magnetically permeable shunt having an aperture therein. The shunt completely surrounds one of the electron beam paths. The improvement comprises the shunt being longer in the first direction than in the second direction and being symmetric about a central axis of the shunt that parallels the first direction and symmetric about another central axis of the shunt that parallels the second direction.

DETAILED DESCRIPTION OF THE PREFERRED EMBODIMENT

Figure 1:
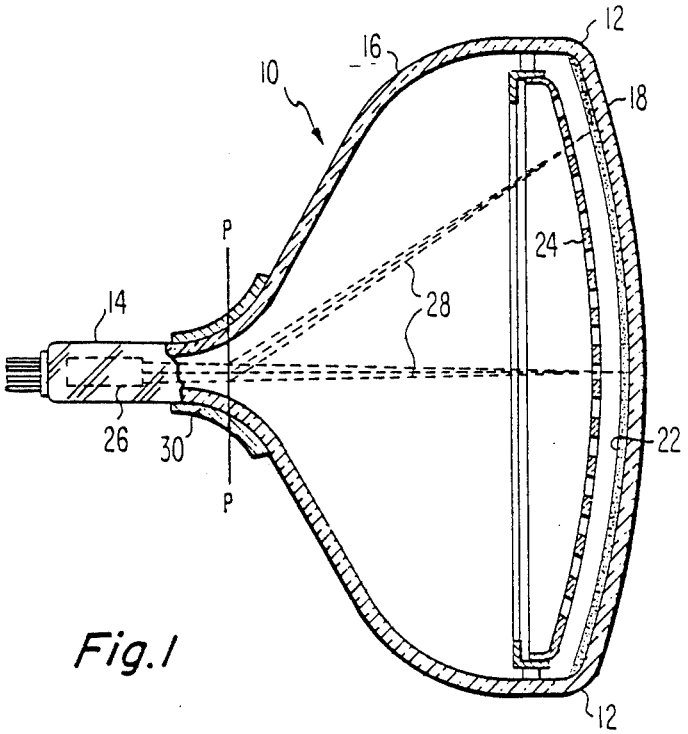
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along initially coplanar convergent paths through the mask 24 to the screen 22.

The tube of FIG. 1 is designed to be used with an external magnetic deflection yoke 30, such as the self-converging yoke, shown surrounding the neck 14 and funnel 12 in the neighborhood of their junction. When activated, the yoke 30 subjects the three beams 28 to vertical and horizontal magnetic flux which causes the beams to scan horizontally and vertically, respectively, in a rectangular raster over the screen 22. The initial plane of deflection (at zero deflection) is shown by the line P-P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
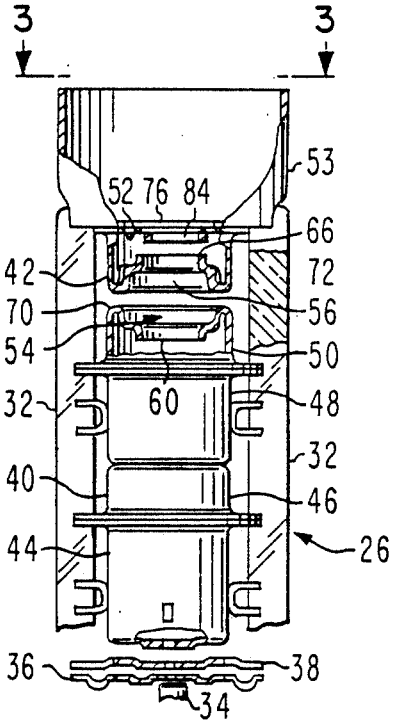
FIG. 2 is a partial axial section view of the electron gun shown in dashed lines in FIG. 1.
Figure 3:
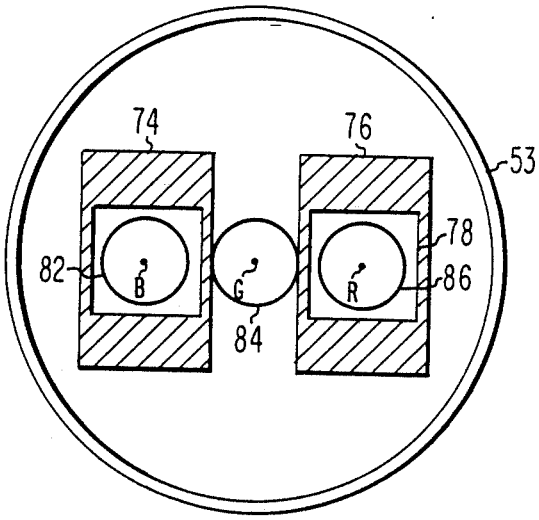
FIG. 3 is an end view of the electron gun of FIG. 2 taken at line 3—3 in FIG. 2 showing coma correction members or shunts.

The details of the electron gun 26 are shown in FIGS. 2 and 3. The gun 26 comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 also is cup-shaped, but has its open end closed with an apertured plate 52. A shield cup 53 is attached to the plate 52 at the exit of the gun 26.

The facing closed ends of the G electrode 40 and the G4 electrode 42 have large recesses 54 and 56, respectively, therein. The recesses 54 and 56 set back the portion of the closed end of the G3 electrode 40 that contains three apertures 60, (center aperture shown), from the portion of the closed end of the G4 electrode 42 that contains three apertures 66, (center aperture shown). The remaining portions of these closed ends of the G3 electrode 40 and the G4 electrode 42 from rims 70 and 72, respectively, that extend peripherally around the recesses 54 and 56. The rims 70 and 72 are the closest portions of the two electrodes 40 and 42.

Located on the bottom of the shield cup 53 are two magnetically permeable coma correction members or shunts 74 and 76. The bottom of the shield cup 53 includes three apertures, 82, 84 and 86, through which the electron beams pass. The centers of the undeflected electron beam paths are designated R, G and B. The R and B paths are the outer beam paths, and the G path is the center beam path.

FIG. 3 shows the shunts 74 and 76 in greater detail. Each shunt is a flat plate having a rectangular outer periphery and a square, centered aperture 78 therein. Two of the sides of the aperture 78 are parallel to the inline direction of the inline electron beams, and two of the sides are perpendicular to the inline direction of the inline electron beams. The shunts 74 and 76 are centered on the two outer or side apertures 82 and 86 in the shield cup 53.

Typical dimensions for the shunts 74 and 76 when used in an inline electron gun having a center-to-center aperture spacing of 5.08 mm (200 mils) are as follows.

Outside Dimensions 6.045 mm×7.620 mm
(238 mils×300 mils)

Aperture Dimensions 4.115 mm×4.115 mm
(162 mils×162 mils)

Thickness 0.508 mm (20 mils)

The use of shunts with the foregoing dimensions can provide a raster correction of approximately 46 mm/gauss.

The shunts 74 and 76 have certain common characteristics that are shared with other shunt embodiments to be described hereinafter. Each shunt is longer in a direction perpendicular to the inline direction of the electron beams than it is in the inline direction of the electron beams. Each shunt is symmetrical about both a vertical axis and a horizontal axis, and the shunts do not overlap the center aperture in the shield cup.

Figure 4:
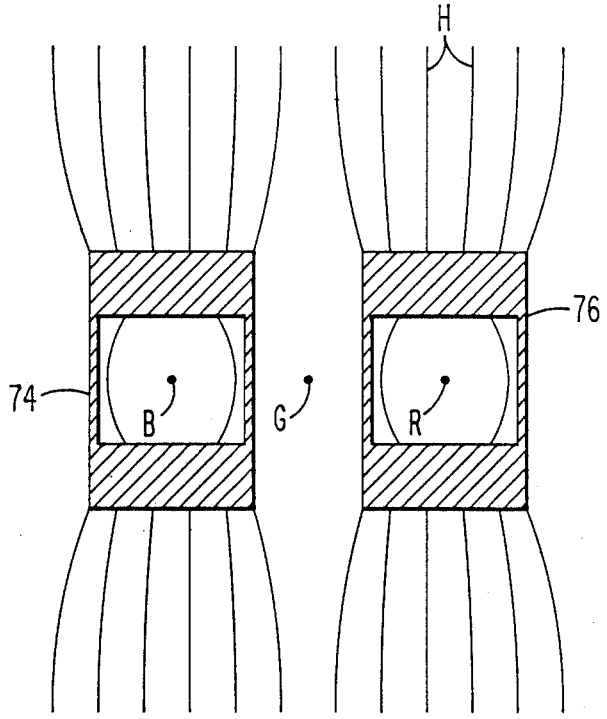
FIGS. 4 and 5 are plan views of the shunts of FIG. 3 showing their effect on the horizontal and vertical magnetic deflection fields, respectively.
Figure 5:
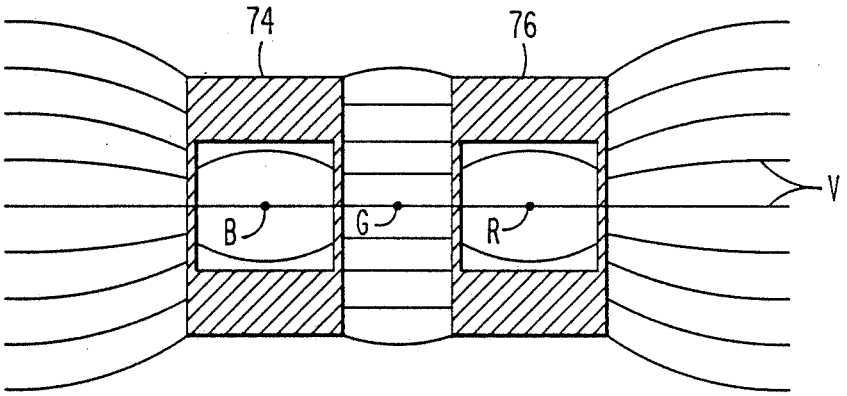

FIGS. 4 and 5 show the effect that the shunts 74 and 76 have on the horizontal and vertical deflection fields, respectively. In FIG. 4, the vertically extending field lines of magnetic flux of the horizontal deflection field H are attracted by the shunts 74 and 76, and most of the lines are bypassed around the two outer beams R and B. The shunts 74 and 76 also bypass a portion of the horizontal deflection field around the center beam G. In FIG. 5, the horizontally extending field lines of magnetic flux of the vertical deflection field V are attracted by the shunts 74 and 76, and most of the lines bypass around the two outer beams R and B. At the center beam G, the shunts concentrate or enhance the lines of flux. However, because of the straight facing sides of shunts 74 and 76, the lines of flux are evenly distributed in the area of the center beam G. Although most of the magnetic flux lines are bypassed around the outer beams, some flux lines also pass through the apertures of the shunts. The shapes of these flux lines within the aperture are, to some extent, affected by the shape of the apertures in the shunts. Since the shapes of the flux lines can distort an electron beam, it is important to utilize an aperture in the shunt that is both vertically and horizontally symmetrical. Square, rectangular and circular shunt apertures have been found to be approximately equally effective.

Figure 6:
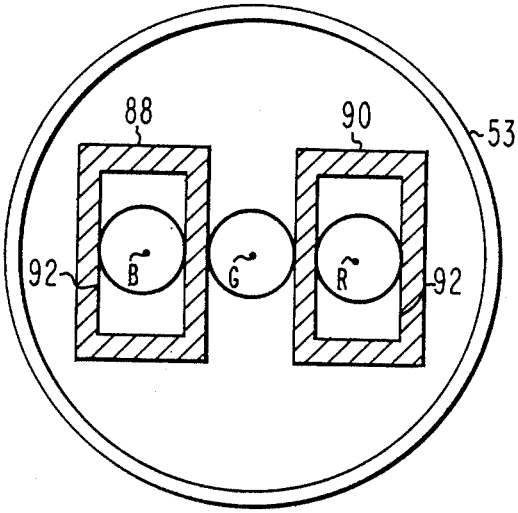
FIG. 6 is an end view of an electron gun having a second coma correction member embodiment therein.

FIG. 6 shows a second embodiment of coma correction members or shunts 88 and 90. Each shunt has a rectangular outer periphery and a rectangular, nonsquare, centered aperture 92 therein. The short sides of the aperture 92 parallel the inline direction of the inline electron beams. The shunts 88 and 90 perform their coma correction function essentially as do the shunts 74 and 76. However, because of the shape of the rectangular apertures therein, which are narrower horizontally but longer vertically, the horizontal flux lines in the apertures are straighter at the beam paths, and the number of vertical flux lines at the beam paths are slightly reduced. Such tailoring of aperture shape can be used as a trimming technique to compensate for minor variations in electron beam distortion.

Figure 7:
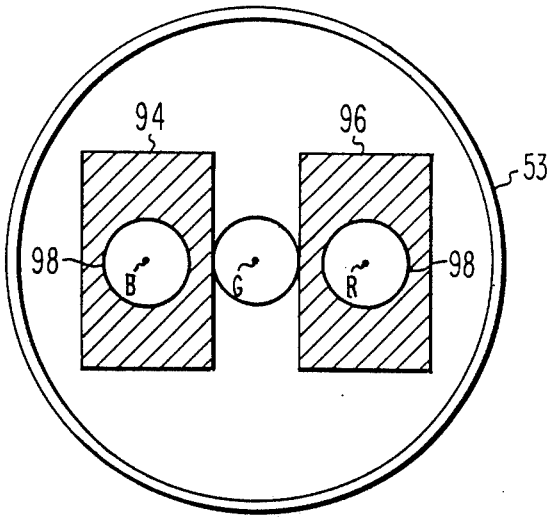
FIGS. 7 and 8 are end views of electron guns having other coma correction member embodiments therein.

FIG. 7 shows a third embodiment of shunts 94 and 96. These shunts 94 and 96 have the same external rectangular configuration as the foregoing shunts but include circular apertures 98. It has been found that the effect of the circular apertures on electron beam quality is very close to that of the square apertures.

Figure 8:
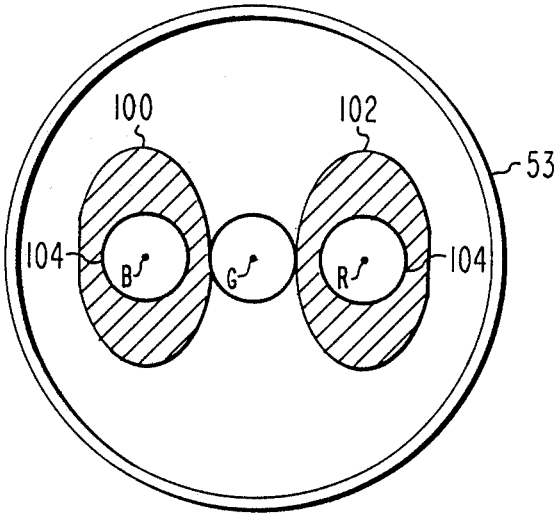

FIG. 8 shows a fourth embodiment of shunts 100 and 102. These shunts 100 and 102 have oval external peripheries and circular apertures 104. The shunts 100 and 102 collect the same amount of horizontal flux lines, but, since they are closer at the center beam, concentrate more of the vertical deflection field (horizontal flux lines) at the center beam G.

What is claimed is:

1. In a cathode-ray tube having an inline electron gun therein for generating three inline electron beams and directing same beams along paths through magnetic deflection fields toward a cathodoluminescent screen of said tube, a first of the fields causing deflection of the beams in a first direction perpendicular to the inline direction of the electron beams, a second of the fields causing deflection of the beams in a second direction parallel to the inline direction of the beams, said gun including means for at least one of said beams, said shunting means comprising at least one magnetically permeable shunt, said shunt being a flat plate having a centered aperture therein, said shunt completely surrounding one of the electron beam paths, the improvement comprising said shunt being longer in the first direction than in the second direction and being symmetric about a central axis of the shunt that parallels the first direction and symmetric about another central axis of the shunt that parallels the second direction, wherein the exterior peripheral shape of said shunt is rectangular, and wherein the aperture in said shunt is rectangular in shape with the sides of the aperture paralleling the external peripheral sides of said shunt.

2. The tube as defined in claim 1, wherein the aperture in said shunt is square in shape.

* * * * *

UNITED STATES PATENT AND TRADEMARK OFFICE
CERTIFICATE OF CORRECTION

PATENT NO. : 4,730,144

DATED : March 8, 1988

INVENTOR(S) : Arthur J. Ingle et al.

It is certified that error appears in the above-identified patent and that said Letters Patent is hereby corrected as shown below:

IN THE SPECIFICATION:

Column 2, Line 14 - "DESCRIPTION OF THE DRAWINGS" should read -- BRIEF DESCRIPTION OF THE DRAWINGS -- ;

Column 3, Line 27 - "ends of the G" should read -- ends of the G3 -- ; and

Column 3, Line 36 - "from" should read -- form -- .

IN THE CLAIMS:

Column 5, Line 4 - "same beams" should read -- said beams -- ; and

Column 5, Line 11 - after "for" insert -- shunting portions of

UNITED STATES PATENT AND TRADEMARK OFFICE

CERTIFICATE OF CORRECTION

PATENT NO. : 4,730,144

DATED : March 8, 1988

INVENTOR(S) : Arthur J. Ingle et al.

It is certified that error appears in the above-identified patent and that said Letters Patent is hereby corrected as shown below:

the deflection fields around --.

Signed and Sealed this

Second Day of August, 1988

*Attest:*

DONALD J. QUIGG

*Attesting Officer*

*Commissioner of Patents and Trademarks*